United States Patent [19]

Van Der Roer

[11] 4,455,934

[45] Jun. 26, 1984

[54] COLOR HEAD FOR OFFSET PRESS

[75] Inventor: Humphrey Van Der Roer, Belfaux Fribourg, Switzerland

[73] Assignee: Fuji Kikai Kogyo Kabushiki Kaisha, Japan

[21] Appl. No.: 419,258

[22] Filed: Sep. 17, 1982

[30] Foreign Application Priority Data

Sep. 17, 1981 [JP] Japan ..... 56-145610

[51] Int. Cl.[3] ..... B41F 17/18; B41F 31/34

[52] U.S. Cl. ..... 101/35; 101/38 R; 101/177; 101/350

[58] Field of Search ..... 101/350, 349, 351, 352, 101/363, 341, 345, 347, 207, 208, 209, 148, DIG. 6, 38 R, 38 A, 177

[56] References Cited

U.S. PATENT DOCUMENTS

| | | | |
|---|---|---|---|
| 1,933,887 | 11/1933 | Wood | 101/351 |
| 2,158,474 | 5/1939 | Misuraca | 101/350 |
| 3,683,805 | 8/1972 | Harcess | 101/350 |

*Primary Examiner*—J. Reed Fisher

*Attorney, Agent, or Firm*—William A. Drucker

[57] ABSTRACT

This invention relates to a color head for an offset press for printing curved articles such as cups, cans, tubes and the like and sheet-like or flat articles such as paper, metals, synthetic resins, and the like. In order to supply the quantity of ink necessary for each article to be printed onto the plate of a plate cylinder for printing the article, an ink roller rotatably provided inside an ink fountain is caused to rock during each printing cycle, in which one article is printed, by cam rings on the sides of the form roller and by rocking levers operated by these cam rings, and is brought into contact with the form roller within a predetermined angular area of the form roller. The quantity of ink supplied can be adjusted continuously without any steps, either manually or automatically, whenever necessary. The roller system used in the invention has a reduced number of rollers so as to shorten the path of the ink and to print each article with a uniform, suitable quantity of ink. The color head is especially suitable as the color head for an offset press for printing the surface of mass-produced cans or tubes.

1 Claim, 11 Drawing Figures

DRAWING

COLOR HEAD FOR OFFSET PRESS

DESCRIPTION

1. Technical Field

This invention relates to a color head for an offset press for use in printing curved articles such as cups, cans, tubes and the like, or sheet-like or film-like flat articles such as paper, metals, synthetic resins and the like.

It is an object of the present invention to print individual articles with exactly the same quantity of ink without any non-uniformity by supplying the required quantity of ink to each article.

It is another object of the present invention to shorten the path of the ink by the use of a roller system having a reduced number of rollers, to make it possible to continuously adjust the quantity of ink supplied, either automatically or manually without any steps, whenever necessary and thus to feed only a suitable quantity of ink.

It is still another object of the present invention to provide a color head which is simple in construction and can be easily and quickly inspected and maintained.

2. Background Art

A color head for dry offset printing generally employs a roller construction consisting of an ink roller rotating while pastly immersed in an ink fountain, a transfer roller, a central rubber roller, two or more oscillating rollers and one or more form rollers in combination with a plate cylinder.

Ink stored in the ink fountain is removed by the transfer roller that alternates contaching the ink roller and the oscillating rollers. The timing of this motion is controlled by one adjustable cam or several fixed cams.

It is to be understood that the timing of the motion is the sum of the time the transfer roller is resting against the ink roller and the time the transfer roller is resting against the first of a series of rollers in the color head roller arrangement.

If the cam or cams are adjusted, this timing can be altered so that about 20% of the time it is resting against the ink roller, and 80% of the time against the first roller, that is, it can be adjusted in the ratio 80% to 20% of the cycle. With fixed cams, the rest times can be divided 75/25%-50/50%-25/75% per cycle.

The plate cylinder holding the printing plate generally completes one cycle whenever it rotates 3 to 7 times. If a color head mechanism using a plate cylinder that rotates 4 turns/cycle is used, for example, four articles are printed in each ink feed cycle. In this case, the ink supply to each article printed is not uniform, as is shown in FIG. 7.

To cope with this problem and to ensure a better ink supply and distribution, a large number of rollers must be used in the roller arrangement so as to smooth the maximum and mininum pasts of the curve of FIG. 7. These rollers superpose the variable ink collection and supply of the ink roller, distribute the ink more uniformly on the plate cylinder and correct the curve to the one shown in FIG. 8.

At times, several rollers are additionally mounted on the oscillating rollers, and two or more form rollers are also added in order to bring the curve of the ink supply to the plate cylinder closer to the theoretical straight line shown in FIG. 8.

A conventional color head having the above-described construction is expensive and consists of a large number of rollers. Accordingly, a greater number of components need to be adjusted, and maintenance and inspection is not easy. Since there are a large number of heat generating parts, the heat generated has an adverse influence on the rubber roller so that the ink already on or supplied to the roller dries up quickly and a longer period of time is needed to wash and re-fit the rollers. These procedures rely upon a high level of skill of the operator during operation.

PREFERRED EMBODIMENT OF THE INVENTION

Figure 1:
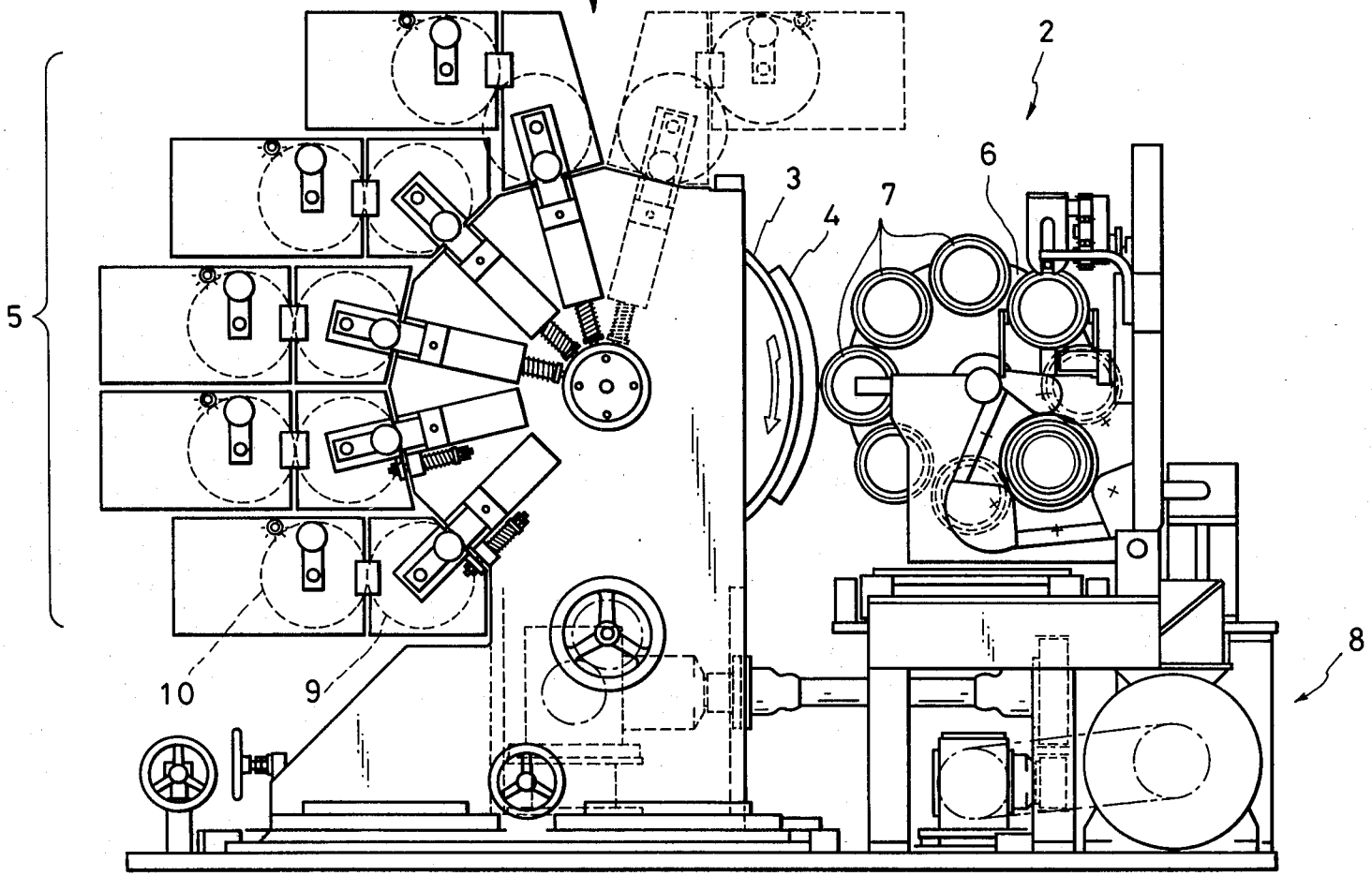
FIG. 1 is a side view of an offset press equipped with the color head of the present invention.
Figure 2:
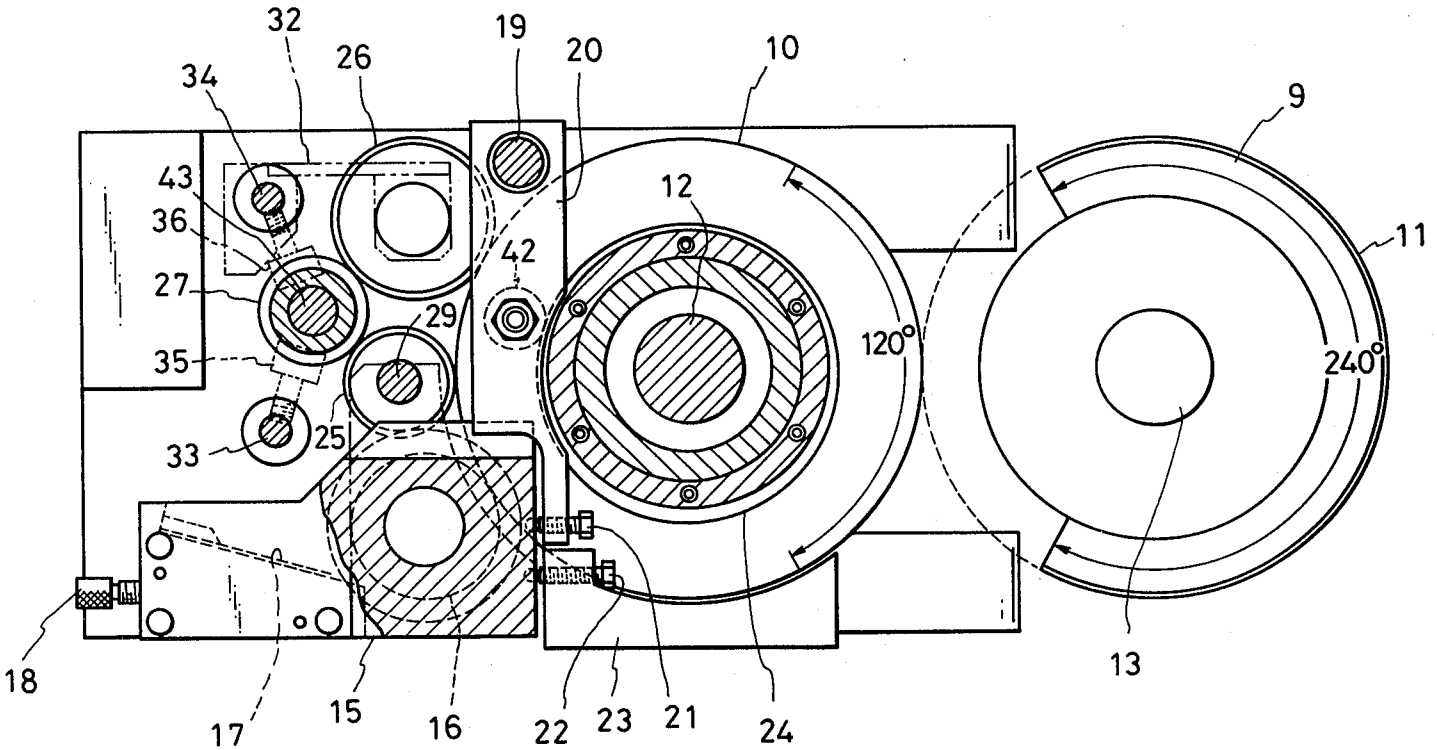
FIGS. 2 and 3 are cross-sectional views of the color head of the present invention.
Figure 3:
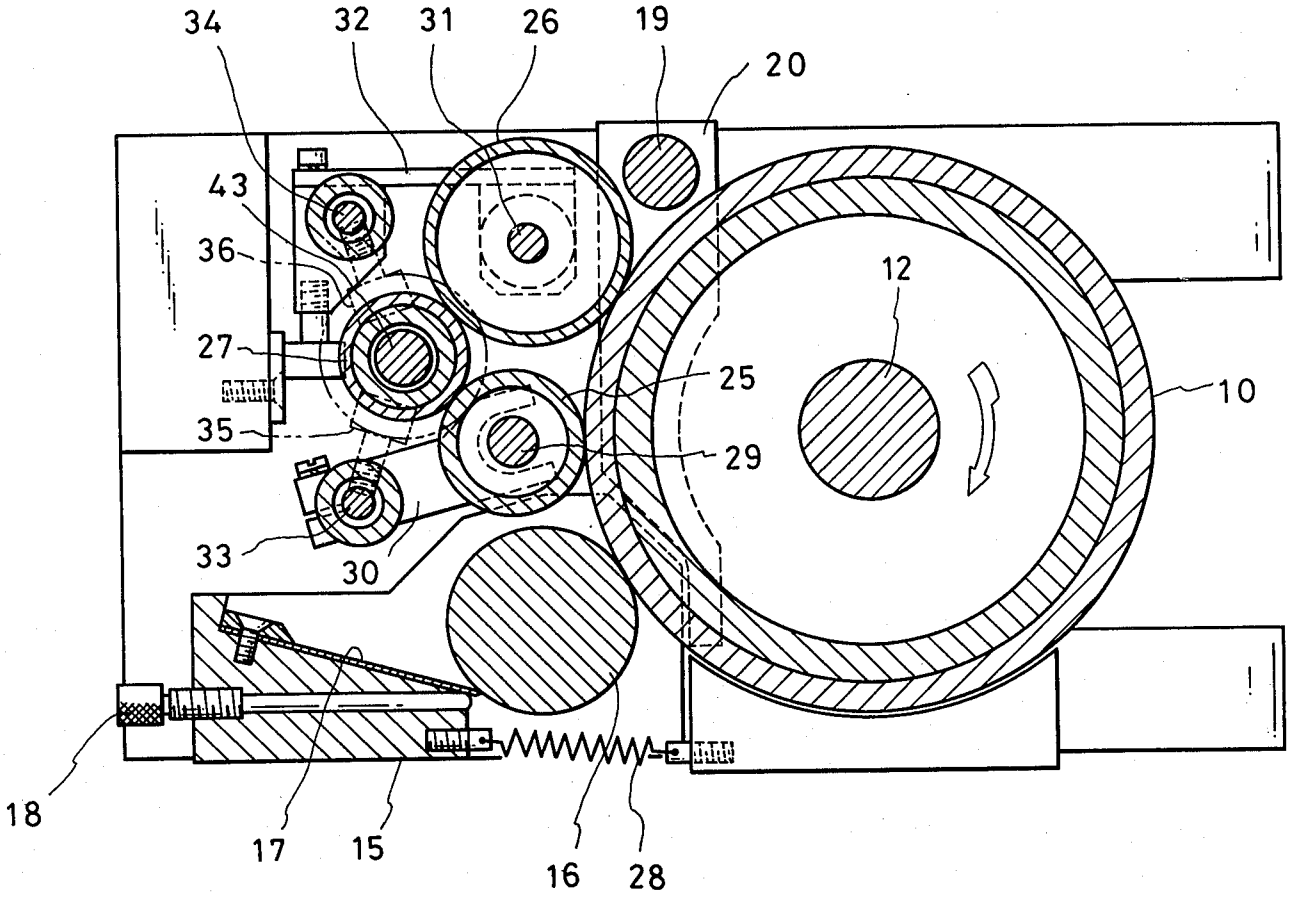

In FIG. 1, reference numeral 1 represents the offset press and reference numeral 2 represents an indexing jig holding the articles to be printed, the jig being attached to the offset press. A blanket cylinder 3 is rotatably mounted on the offset press 1 and four printing blankets 4, for example, are equidistantly mounted on the circumference of this blanket cylinder 3. Reference numeral 5 represents a color head in accordance with the present invention. Several color heads 5 using different colored inks, each equipped with a plate cylinder 9 with a printing plate, a form roller 10 and so on, are disposed around the circumference of the blanket cylinder 3.

A plurality of mandrels 7, to which the articles to be printed such as cans, cups or tubes, are fitted, are equidistantly mounted on the turret 6 of the indexing jig 2. The articles to be printed, that are fitted on the mandrels 7, are sequentially indexed according to the printing positions where they come into contact with one of the blankets 4, and are transferred after being printed. Reference numeral 8 represents the device that drives the indexing jig 2 as well as the offset press 1.

The detailed construction of the color head 5 will be described with reference to FIGS. 2 to 6.

The printing plate 11 is fitted over 240° of the area of the plate cylinder 9, for example, with a gap of 120°. The plate 11 transfers the ink supplied to it to the blanket 4.

The form roller 10 supplies the ink to the plate 11 on the plate cylinder 9 and the ink is not supplied over the remaining 120°. This is because it is not necessary to supply ink in the gap over the range of 120°. The form roller 10 and the plate cylinder 9 are rotatably supported by shafts 12 and 13, respectively. They rotate at the same speed ratio of 1:1 in opposite directions to each other linked by a gear on shaft 13, which is not shown, and a gear 14 on shaft 12 (see FIG. 4). The gear on shaft 13, not shown, is constructed so as to be turned by a gear on the rotating shaft of the blanket cylinder 3, not shown in the drawing.

Reference numeral 15 represents the ink fountain which stores the ink. The ink roller 16, part of which is immersed in the ink, is rotatably disposed in the ink fountain 15 so as to rotate in synchronism with the form roller 10 through a rotation transmission mechanism using a gear 38. Reference numeral 17 represents a duct and reference numeral 18 represents a knob which adjusts the position of the end of the duct 17.

The ink fountain 15 is held by a pair of rocking levers 20 so as to be able to move towards the form roller 10 and is constantly urged by a spring 28 toward the form roller so that the ink roller 16 is in contact with the form roller 10.

The upper end of each rocking lever 20 is pivoted about an eccentric shaft 19. A follower roller 42 is pivoted on each rocking lever 20 so that it comes into contact with cam rings 24 disposed on each side of the form roller 10. The cam rings 24 have the profile of an eccentric ring so that the ink roller 16 comes into contact with the form roller 10 during the range of 120° in which ink is supplied to the form roller 10, but it moves to a tripped position during the remaining 240° in which it does not come into contact with the form roller 10.

The ink roller 16 is made to move by the cam rings 24 and it comes into and out of contact with the form roller 10 in the following manner. When the rocking levers 20 are made to rock about the pivot of the eccentric shaft 19 by the cam followers 42 which are constantly kept in contact with the cam rings 24, the ink fountain 15 is moved, but the angle of rocking of the rocking levers 20 can be changed by turning a knob 37 so as to rotate the eccentric shaft 19 which is the rocking pivot of the rocking levers, either manually or by means of an automatic controlling device, not shown. This adjustment makes it possible to change the time during which the ink roller 16 is in contact with the form roller 10 within the range of from 0 to 120 degrees. The adjustment also adjusts the ink density since the longer the ink roller 16 is in contact with the form roller 10, the greater the ink supply and the higher the printing density. Similarily, the shorter the contact time, the smaller the ink supply and the lower the density.

Reference numerals 21 and 22 represent end stoppers for the ink fountain 15. One of the end stoppers 21 is disposed at the end of a rocking lever 20 while the other 22 is disposed on a frame 23. These are used for fine adjustments of the rocking of the ink fountain 15, that is, the ink roller 16.

Two oscillating rollers 25, 26 and one intermediate rubber roller 27 are provided in order to knead the ink that is supplied by the ink roller 16 to the form roller 10.

The first oscillating roller 25 is supported by a support shaft 29 immediately above the ink roller 16 so as to be capable of rotating about and reciprocating along its axis, and be constantly in contact with the form roller 10. The second oscillating roller 26 is supported by a support shaft 31 above the first ocillating roller 25 so as to be capable of rotating about and reciprocating along its axis, and be constantly in contact with the form roller 10. The intermediate rubber roller 27 is supported by a rotating shaft 43 between the oscillating rollers 25, 26 so as to be in contact with them. The rotating shaft 43 of the intermediate rubber roller 27 transmits rotation from the side of the form roller 10 by a gear 39. Accordingly, the first and second oscillating rollers 25 and 26 are made to rotate by the contact of the intermediate rubber roller 27 with the form roller 10.

Figure 4:
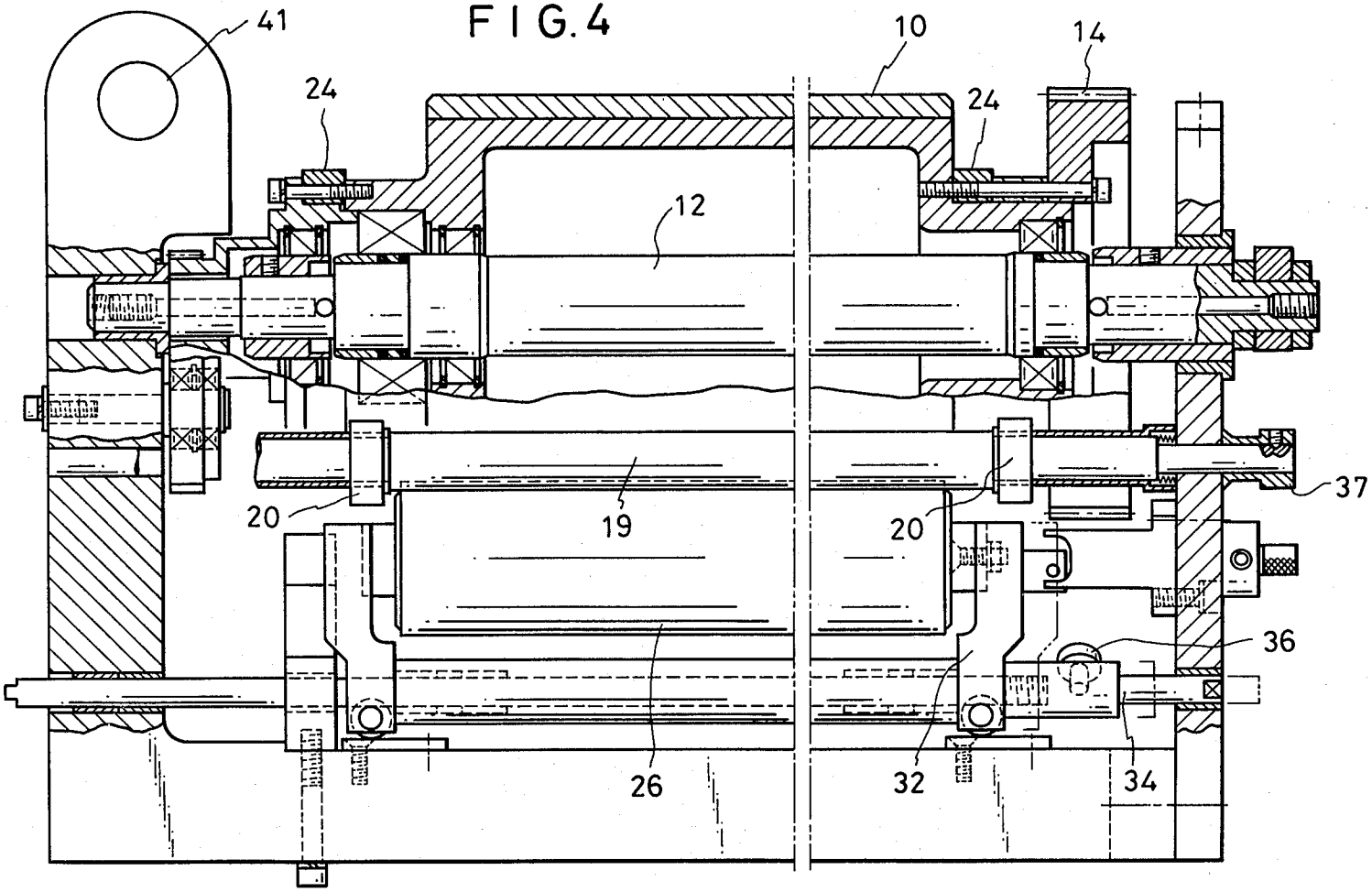
FIG. 4 is a partially sectioned plan view.
Figure 5:
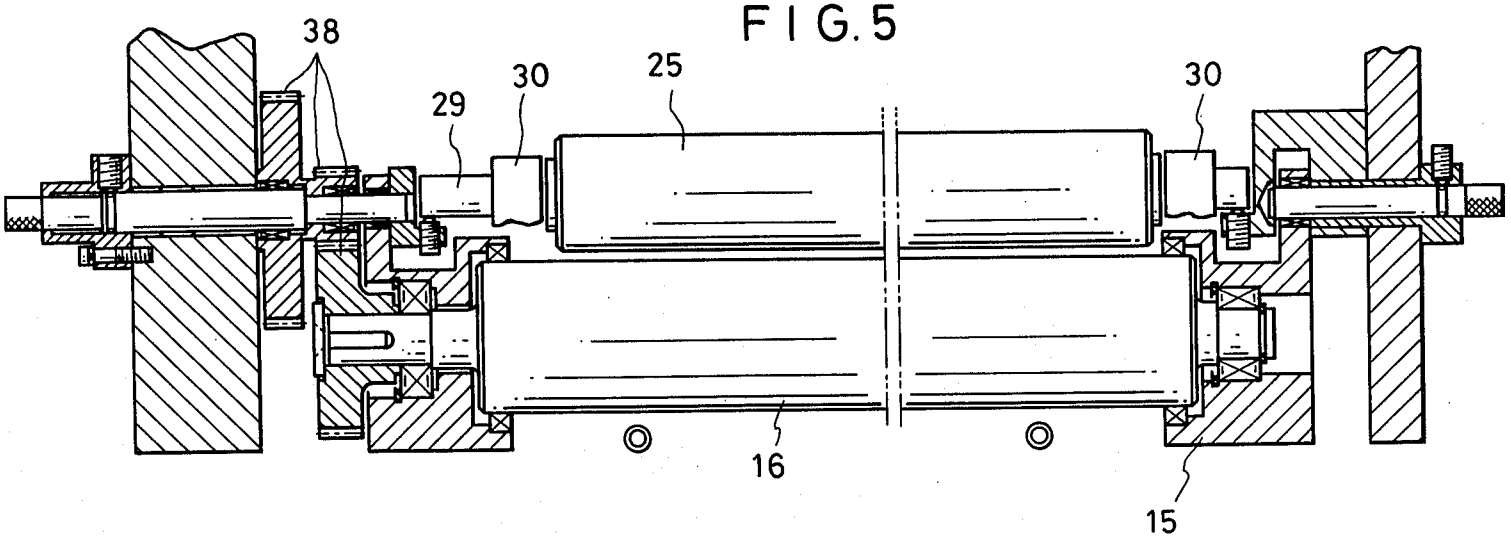
FIG. 5 is a front view of the ink roller and the first oscillating roller.
Figure 6:
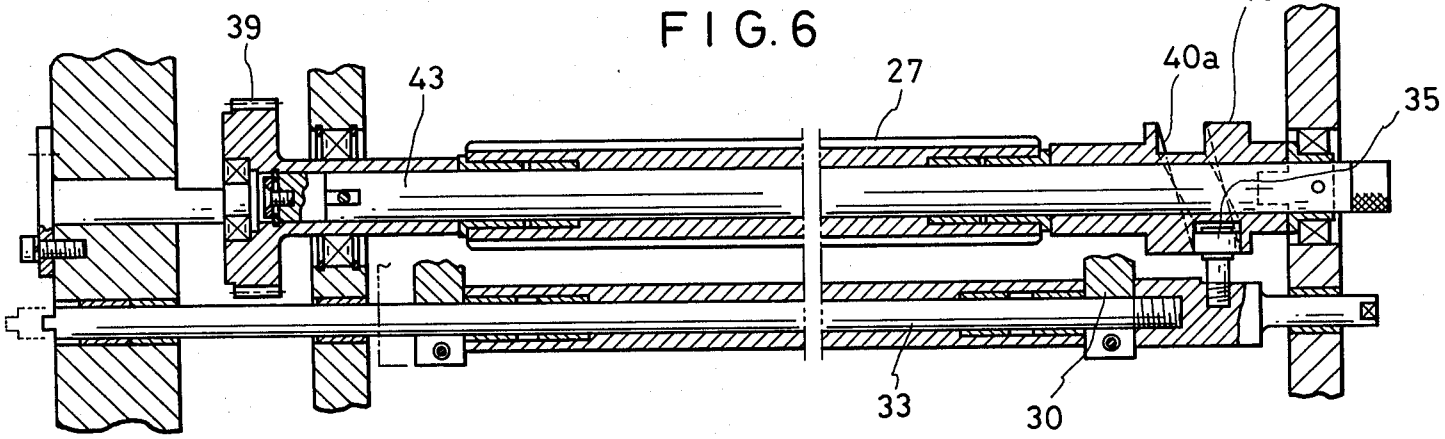
FIG. 6 is a sectional view of the intermediate rubber roller.
Figure 7:
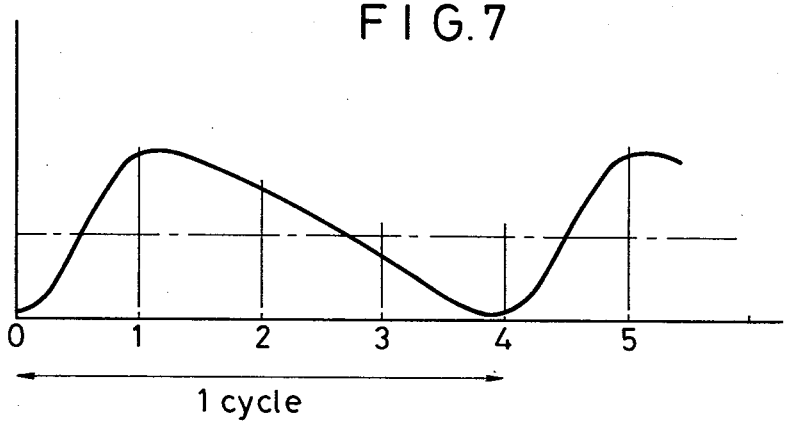
FIGS. 7 and 8 are graphs, each showing one ink supply cycle in the conventional color head.
Figure 8:
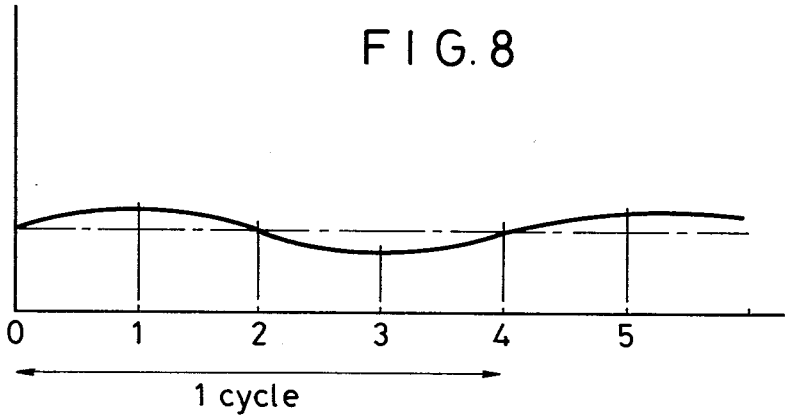

The reciprocating mechanism of the first and second oscillating rollers 25, 26 in the axial direction is constructed as follows. A rocking cam member 40, which includes a cam groove **40*a* displaced at an angle to the axial direction, is disposed on the rotating shaft 43 of the intermediate rubber roller 27, and the first oscillating roller 25 is connected to a support 30 fixed on the support shaft 33 and guides a cam follower 35 mounted or the support shaft 33 into the abovementioned cam groove 40*a* so that it engages with the cam groove 40*a*. Incidentally, reference numeral 41 in FIG. 4 represents a hinge for moving the form roller 10 with respect to the plate cylinder 9**.

Next, the operation of the color head of the present invention having the abovementioned construction will be explained.

The form roller 10 has the same outer diameter as that of the plate cylinder 9 when the plate 11 is fitted thereto. The form roller 10 and the plate cylinder 9 are rotated in synchronism with each other by gears having the reduction ratio of 1:1. The form roller 10 is always in contact with an area over 240° of the circumference of the plate cylinder 9. The remaining 120° of the plate cylinder 9 never contacts the plate 11.

When adjusted by the cam ring 24 and the eccentric shaft 19, the ink roller 16 supplying ink to the form roller 10 can come into contact with the form roller 10 within a setting range of 0° to 120°, and supplies ink from the ink fountain to the form roller 10. Outside the setting range of 0° to 120°, the ink roller 16 is released by the operation of the rocking levers 20 to a position where it does not come into contact with the form roller 10.

A suitable quantity of ink supplied to the form roller 10 within the abovementioned setting range is kneaded by the first and second oscillating rollers 25, 26 and the intermediate rubber roller 27, and the ink on the circumference of the form roller 10 is spread uniformly.

Figure 9:
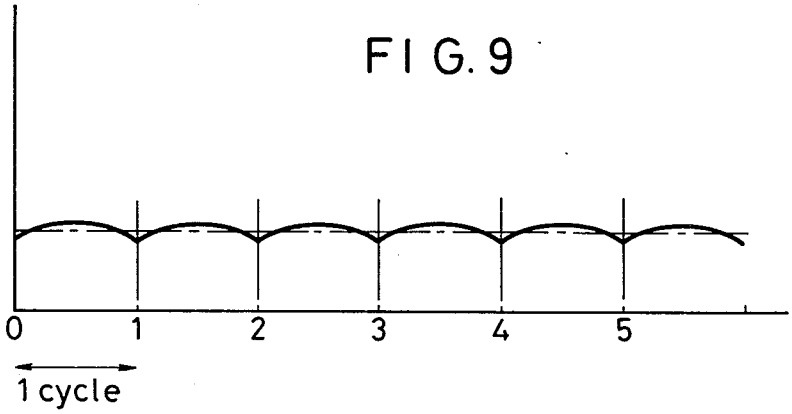
FIG. 9 is a graph showing one ink supply cycle in the color head of the present invention.

The ink that has thus been supplied to the form roller 10 is transferred to the plate 11 on the plate cylinder 9 and thence to the blanket 4 on the blanket cylinder 3 so as to print the articles such as the cans, cups, tubes or the like that are mounted on the mandrels 7 of the indexing jig 2. The blankets 4 equidistantly provided on the blanket cylinder 3 each print an article. As ink is transferred by the plate 11 on the plate cylinder 9 to each blanket 4 and is transferred from the form roller 10 to the plate 11, a suitable quantity of ink is supplied by the ink roller 16 to the form roller 10. Accordingly, a suitable quantity of ink is supplied for each cycle in which each article is printed, as shown in FIG. 9, thereby always ensuring uniform printing.

Figure 10:
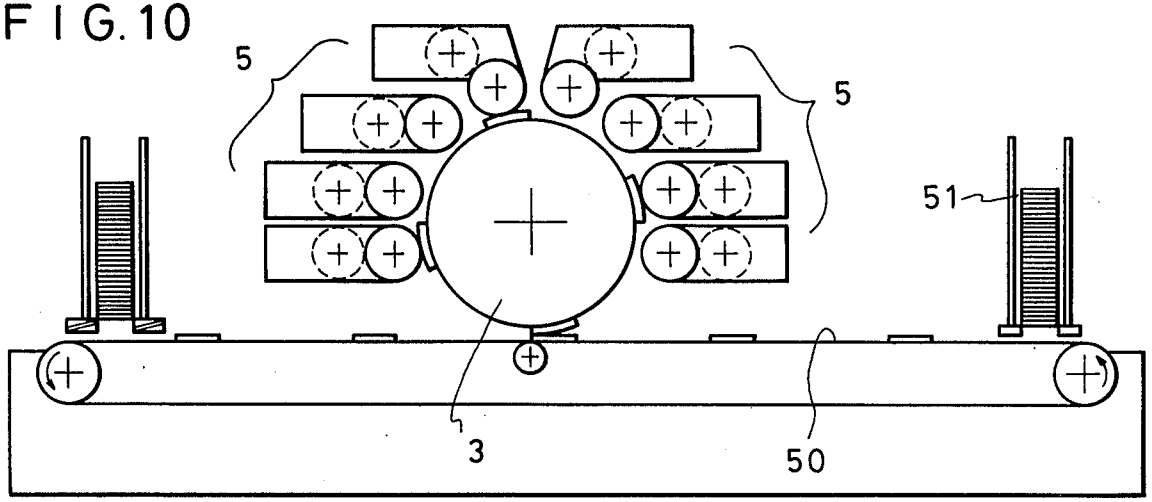
FIGS. 10 and 11 are side views showing other embodiments of the present invention.
Figure 11:
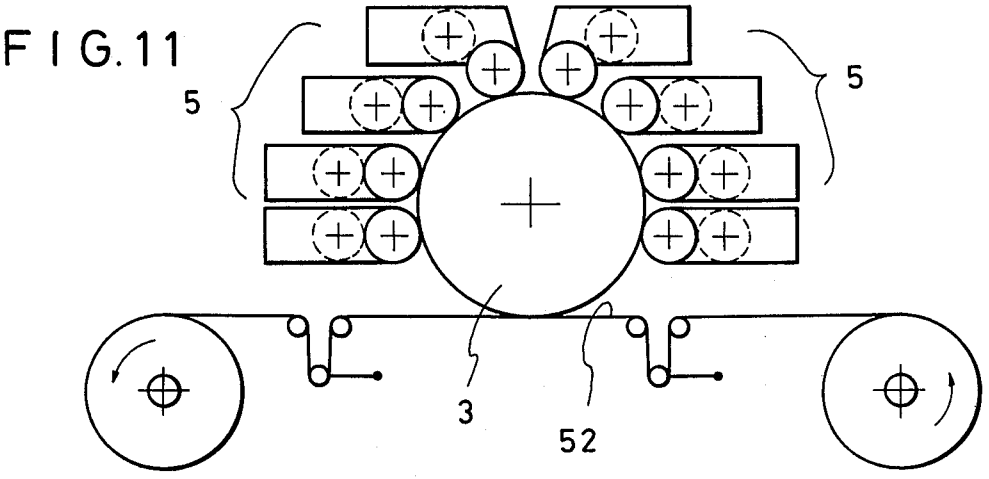

Though the foregoing embodiment deals with the case in which the invention is applied to printing of curved articles such as cups, cans, or tubes, an offset press using the color head of the present invention can print flat articles of paper, metal sheet, or synthetic resin film, and so forth. Two embodiments of such an application will be typically explained with reference to FIGS. 10 and 11. In the embodiment shown in FIG. 10, a conveyor belt 50 is provided below the blanket cylinder 3 and the articles to be printed are removed from a magazine 51 holding the flat articles to be printed, positioned at one end of the conveyor belt 50, and are conveyed by the conveyor belt 50 so as to pass below the blanket cylinder 3 to be printed. In the embodiment shown in FIG. 11, the articles to be printed 52 are made of elongated thin paper or synthetic resin film wound or a roll. In this system, the wound articles 52 are passed below the blanket cylinder 3, printed and taken up. Besides the above-mentioned mebodiments, the system of printing articles or a offset press using the color head of the present invention can be modified in design whenever necessary. Hence, the present invention is not limited to the printing of curved articles, in particular.

The present invention provides the following advantages. First, the greatest advantage of the present invention is that the ink roller rocks during each cycle, or whenever an article is printed, and supplies a suitable quantity of ink to the form roller so that printing can be carried out with a constant and uniform quantity of ink as shown by the curve in FIG. 9.

In the roller arrangement of the present invention, the number of rollers is reduced to one ink roller, two oscillating rollers and one intermediate rubber roller. Accordingly, the path of the ink is shortened in comparison with the conventional roller arrangement using a greater number of rollers. Hence, the color head can be made compact and a plurality of color heads 5 using different colored inks can be installed around the blanket cylinder effectively.

The quantity of ink supplied by the ink roller can be continuously and uniformly adjusted by adjusting the eccentric shaft so that a suitable quantity of ink is always reliably supplied to each article to be printed.

Furthermore, the form roller, the intermediate rubber roller and the ink fountain can be mounted or removed easily and quickly, simplifying maintenance and inspection. Fitting of an optional print or ink flow stopping device becomes possible and the installation of a servo motor for continuously controlling hue comparison and quantity can be made. Hence, the present invention is suitable for an apparatus using colored photoelectric tubes.

What is claimed is:

1. A color head for an offset press comprising: a plate cylinder and a form roller rotating at the same speed while in contact with each other; an ink roller rotatably supported inside an ink fountain and made to come in to and out of contact with said form roller by rocking levers; a cam ring disposed on each side of said form roller so that said fountain roller comes into contact with said form roller within a predetermined angular area of said form roller and supplies the ink to said form roller in each cycle in which one article is printed; a cam follower adapted to each said rocking levers so as to always be in contact with a respective said cam ring; said rocking levers are pivoted about an eccentric shaft for changing the time during which said fountain roller is in contact with said form roller so as to adjust the quantity of ink supplied within said predetermined angular area; two oscillating rollers adapted so as to be in contact with said form roller; and an intermediate rubber roller disposed between said oscillating rollers and in contact with them.

* * * * *